US012083409B2

(12) United States Patent
Holbert et al.

(10) Patent No.: US 12,083,409 B2
(45) Date of Patent: Sep. 10, 2024

(54) SIT SKIS AND SIT SKI ASSEMBLIES

(71) Applicant: TRD U.S.A., Inc., Torrance, CA (US)

(72) Inventors: Todd Holbert, Oak Ridge, NC (US); Henri G. Durand, Charlotte, NC (US); Kenneth M. Brown, Mooresville, NC (US)

(73) Assignee: TRD U.S.A., Inc., Torrance, CA (US)

( * ) Notice: Subject to any disclaimer, the term of this patent is extended or adjusted under 35 U.S.C. 154(b) by 0 days.

(21) Appl. No.: 17/989,812

(22) Filed: Nov. 18, 2022

(65) Prior Publication Data

US 2023/0415023 A1 Dec. 28, 2023

Related U.S. Application Data

(60) Provisional application No. 63/356,161, filed on Jun. 28, 2022.

(51) Int. Cl.
*A63C 11/00* (2006.01)

(52) U.S. Cl.
CPC ..... *A63C 11/001* (2013.01); *A63C 2201/10* (2013.01); *A63C 2203/20* (2013.01)

(58) Field of Classification Search
CPC ..... A63C 11/001; A63C 2201/10; A63C 2203/20; A63C 11/00
USPC ..... 280/14.1
See application file for complete search history.

(56) References Cited

U.S. PATENT DOCUMENTS 4,193,609 A * 3/1980 Bissett ..... B62B 13/04 280/28.14
4,374,591 A * 2/1983 Kobayashi ..... B62M 27/02 280/21.1
4,632,408 A * 12/1986 Olpp ..... A63C 5/031 280/28.14
5,344,167 A * 9/1994 Strouth ..... B62B 13/12 280/22.1
6,019,380 A * 2/2000 Goodman ..... B62B 13/04 280/22.1

(Continued)

FOREIGN PATENT DOCUMENTS

DE 8427892 U1 1/1985
DE 3402966 A1 7/1985
KR 200312797 Y1 5/2003

OTHER PUBLICATIONS

M. Cavacece, F. Smarrini, P.P. Valentini and L. Vita, Kinematic and dynamic analysis of a sit-ski to improve vibrational comfort https://sci-hub.hkvisa.net/10.1007/bf02844128, Mar. 2005, 13 pgs.

(Continued)

*Primary Examiner* — James A Shriver, II
*Assistant Examiner* — Hilary L Johns
(74) *Attorney, Agent, or Firm* — Dinsmore & Shohl LLP

(57) ABSTRACT

A sit ski for an athlete includes a ski, a bucket disposed above the ski and configured to support the athlete, and a suspension disposed between the ski and the bucket. The suspension includes a support frame coupled to the ski, a first rotatable member rotatably coupled to the bucket and to the support frame, a second rotatable member rotatably coupled to the bucket and to the support frame, a shock coupled to the bucket and to the support frame, and a bump stop configured to contact the bucket.

18 Claims, 5 Drawing Sheets

(56) References Cited

U.S. PATENT DOCUMENTS 6,113,115 A * 9/2000 Hurth ..... A63C 5/031 280/14.1
6,179,305 B1 * 1/2001 Capozzi ..... B62B 17/06 280/14.1
6,279,925 B1 * 8/2001 Miller ..... B62B 13/12 280/22.1
8,109,523 B2 * 2/2012 Kolesar ..... B62B 13/04 280/14.28
8,308,172 B2 * 11/2012 Gulbranson ..... B62B 13/043 280/14.1
9,403,551 B2 * 8/2016 Van Der Werf ..... B62B 17/061
10,874,933 B2 * 12/2020 Thompson ..... B62B 17/062
11,220,283 B2 * 1/2022 Proulx ..... B62B 17/04
2002/0070530 A1 * 6/2002 Gouzes ..... A63C 10/24 280/623
2003/0164258 A1 * 9/2003 Lalonde ..... B60R 21/00 180/271
2004/0083626 A1 * 5/2004 Trask ..... A63C 13/005 36/125
2004/0100044 A1 * 5/2004 Monike ..... B62B 17/08 280/14.1
2005/0001391 A1 * 1/2005 Piper ..... B62B 13/12 280/14.1
2006/0273558 A1 * 12/2006 Breed ..... B60R 21/206 280/730.2
2009/0140503 A1 * 6/2009 Kolesar ..... B61B 11/008 104/173.2
2014/0239617 A1 * 8/2014 Dix ..... B60R 21/203 280/729
2016/0001806 A1 * 1/2016 Van Der Werf ..... B62B 17/061 280/14.1
2016/0042655 A1 * 2/2016 Sweet ..... G09B 9/00 434/305
2018/0111662 A1 * 4/2018 Ball ..... B62L 1/00
2021/0380170 A1 * 12/2021 Wilmot ..... B60K 17/34
2021/0387673 A1 * 12/2021 Rödiger ..... B62D 29/043

OTHER PUBLICATIONS

Roger Lohr, Nordic adaptive sit-skis bring freedom to mobility impaired persons https://www.xcskiresorts.com/resort-features/2016/9/12/nordic-adaptive-sit-skis-bring-freedom-to-mobility-impaired-persons, Jul. 29, 2022, 7 pgs.

* cited by examiner

SIT SKIS AND SIT SKI ASSEMBLIES

CROSS REFERENCE TO RELATED APPLICATIONS

The present application claims the benefit of U.S. Provisional Application Ser. No. 63/356,161, filed Jun. 28, 2022, which is hereby incorporated by reference in its entirety.

TECHNICAL FIELD

The present specification generally relates to sit skis and sit ski assemblies for athletes and in particular, sit skis for athletes with physical disabilities relating to the lower parts of the body.

BACKGROUND

Sit skis are devices used by athletes to ski while in a seated position. Sit skis may support the weight of the athlete over a ski and may retain the athlete in place. Accordingly, some sit skis may be heavy and bulky.

SUMMARY

Additional features and advantages of the present disclosure will be set forth in the detailed description, which follows, and in part will be apparent to those skilled in the art from that description or recognized by practicing the embodiments described herein, including the detailed description, which follows the claims, as well as the appended drawings.

In one non-limiting aspect, a sit ski for an athlete includes a ski, a bucket disposed above the ski and configured to support the athlete, and a suspension disposed between the ski and the bucket. The suspension includes a support frame coupled to the ski, a first rotatable member rotatably coupled to the bucket and to the support frame, a second rotatable member rotatably coupled to the bucket and to the support frame, a shock coupled to the bucket and to the support frame, and a bump stop configured to contact the bucket.

In another non-limiting aspect, a sit ski for an athlete includes a ski, a bucket disposed above the ski and configured to support the athlete, and a suspension disposed between the ski and the bucket. The bucket includes a bucket bottom, a bucket top selectively coupleable to the bucket bottom, and an airbag disposed on the bucket top. The suspension includes a support frame coupled to the ski, a first rotatable member rotatably coupled to the bucket and to the support frame, a second rotatable member rotatably coupled to the bucket and to the support frame, and a shock coupled to the bucket and to the support frame.

In another non-limiting aspect, a sit ski assembly includes a ski, a bucket disposed above the ski and configured to support the athlete, and a suspension disposed between the ski and the bucket. The bucket comprising an airbag disposed therein. The suspension includes a support frame coupled to the ski, a first rotatable member rotatably coupled to the bucket and to the support frame, a second rotatable member rotatably coupled to the bucket and to the support frame, a shock coupled to the bucket and to the support frame, and a bump stop configured to contact the bucket.

It is to be understood that both the foregoing general description and the following detailed description describe various embodiments and are intended to provide an overview or framework for understanding the nature and character of the claimed subject matter. The accompanying drawings are included to provide a further understanding of the various embodiments and are incorporated into and constitute a part of this specification. The drawings illustrate the various embodiments described herein, and together with the description, explain the principles and operations of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1A:
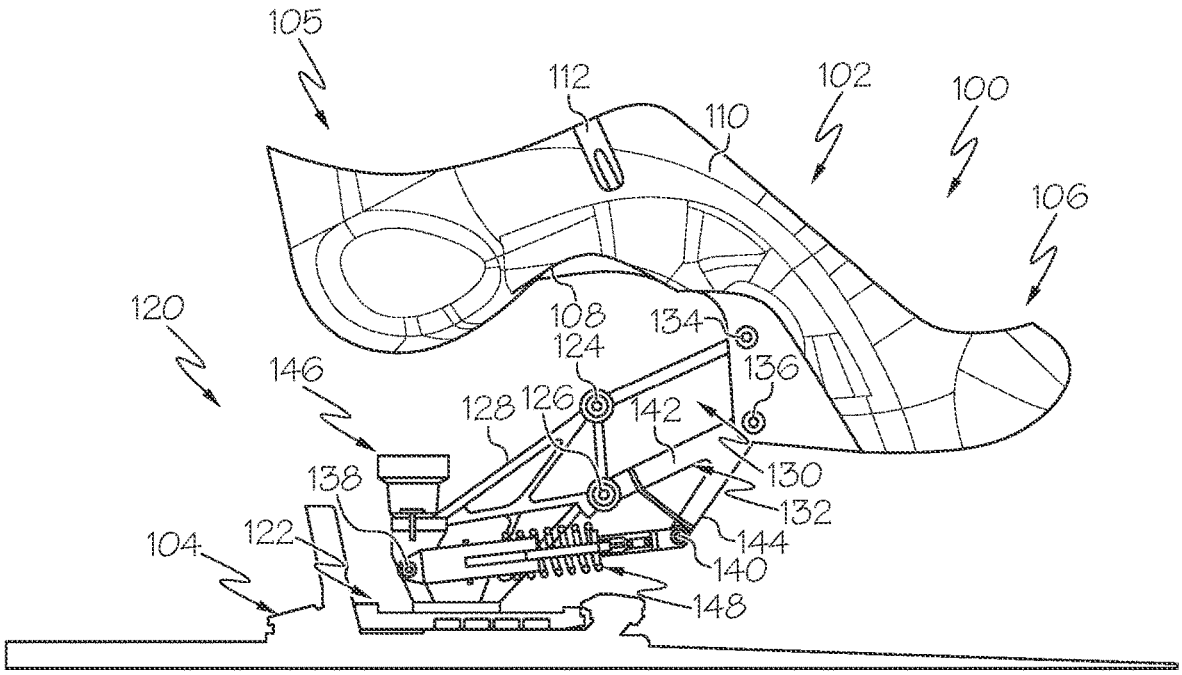
FIG. 1A schematically depicts a side view of a sit ski according to one or more embodiments shown and described herein.
Figure 1B:
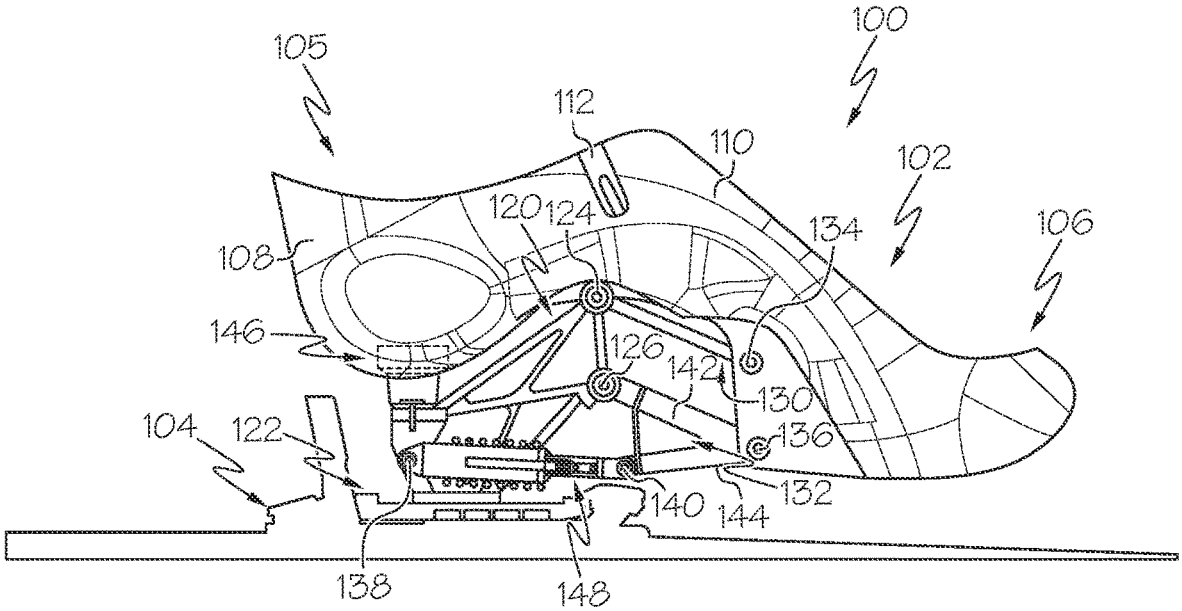
FIG. 1B schematically depicts a side view of the sit ski of FIG. 1A in an exaggerated bottomed out position according to one or more embodiments shown and described herein.

Reference will now be made in detail to various embodiments of devices, assemblies, and methods, examples of which are illustrated in the accompanying drawings. Whenever possible, the same reference numerals will be used throughout the drawings to refer to the same or like parts. FIGS. 1A and 1B schematically depict a sit ski which may include a ski, a bucket disposed above the ski and configured to support the athlete, and a suspension disposed between the ski and the bucket. The suspension may include a support frame coupled to the ski, a first rotatable member rotatably coupled to the bucket and to the support frame, a second rotatable member rotatably coupled to the bucket and to the support frame, a shock coupled to the bucket and to the support frame, and a bump stop configured to contact the bucket. The bucket may "bottom out" or engage the bump stop when the bucket is at its lowest position. Accordingly, the shock need not be stiff enough to prevent bottoming out of the bucket. This may allow for the shock to be a lower weight shock, thereby enabling the sit ski to be lower weight overall. These features and other weight saving features are described herein. In this way, the sit ski may be lighter and, therefore, faster than conventional designs.

Directional terms as used herein—for example up, down, right, left, front, back, top, bottom—are made only with reference to the figures as drawn and are not intended to imply absolute orientation unless otherwise specified. The terms proximal and distal are used herein to reference a direction toward a coaxial equipment port and away from a coaxial equipment port, respectively.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any device or assembly claim does not actually recite an order or orientation to individual components, or it is not otherwise specifically stated in the claims or description that the steps are to be limited to a specific order, or that a specific order or orientation to components of an device or assembly is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation; and the number or type of embodiments described in the specification.

As used herein, the singular forms "a," "an" and "the" include plural referents unless the context clearly dictates otherwise. Thus, for example, reference to "a" component includes aspects having two or more such components, unless the context clearly indicates otherwise.

Referring now to FIGS. 1A and 1B, the sit ski 100 includes a bucket 102 mounted above a ski 104. The bucket 102 extends from a seat portion 105 of the bucket 102 to a toe portion 106 of the bucket 102 such that it may support the full length of the leg portion of the athlete. The bucket 102 is configured to wrap around the leg portion of the athlete (e.g. about the top and bottom of the leg portion of the athlete) such that it may fully encircle or enclose the leg portion of the athlete within the interior of the bucket 102. In particular, the bucket 102 may have a bucket bottom 108 and a bucket top 110 removably coupled to the bucket bottom 108. The bucket bottom 108 may be configured to support a weight of the athlete from beneath the athlete. The bucket top 110 may be configured to enclose the leg portion of the athlete from above the athlete. The bucket top 110 may be removably coupleable to the bucket bottom 108 such that the athlete may enter and exit the bucket 102 when the bucket top 110 is separated from the bucket bottom 108 and such that the athlete may be retained within the bucket 102 when the bucket top 110 is coupled to the bucket bottom 108. In embodiments, the bucket top 110 may be coupled to the bucket bottom 108 via latches 112. The bucket top 110 may include alignment features such as rivets 114 (depicted, for example, in FIG. 3) which may mate with corresponding apertures (not depicted) of the bucket bottom 108.

The bucket 102, including the bucket top 110 and the bucket bottom 108, may be made from carbon fiber of other sufficiently strong load bearing material. Accordingly, the bucket 102 may fully support the weight of the athlete without need for a metal frame extending along the bucket 102. This may reduce the overall weight of the sit ski. In some embodiments, the bucket top 110 may be made from the same material as the bucket bottom 108. In other embodiments, the materials of the bucket top 110 and the bucket bottom 108 may vary.

Still referring to FIGS. 1A and 1B, the sit ski 100 may include a suspension 120 disposed between the bucket 102 and the ski 104. The suspension 120 may include a support frame 122 coupled to the ski 104. In particular, the support frame 122 may be selectively coupled to the ski 104 at a plurality of lateral locations, i.e. forward and aft, along the ski 104. Accordingly, the support frame 122 may be selectively positioned along the ski 104 to control the location of the athlete along the ski 104. This may allow the position of the center of gravity of the athlete to be customized.

The support frame 122 may extend from the ski 104 to a first joint 124 and a second joint 126. Between the ski 104, the first joint 124, and the second joint 126 may be a plurality of load bearing members 128. The support frame 122 including the load bearing members 128, the first joint 124, and the second joint 126 may be fixed to the ski 104 such that the support frame 122 is immobile relative to the ski 104.

Still referring to FIGS. 1A and 1B, the suspension 120 may include a first rotatable member 130, and a second rotatable member 132. The first rotatable member 130 and the second rotatable member 132 may each be rotatably coupled to the support frame 122 such that the first rotatable member 130 and the second rotatable member 132 may each pivot relative to the support frame 122. In particular, the first rotatable member 130 and the second rotatable member 132 may be rotatably coupled at the first joint 124 and the second joint 126, respectively. In some embodiments, the second rotatable member 132 may include a first arm 142 and a second arm 144 disposed at an angle to the first arm 142. In such embodiments, the second rotatable member 132 may be rotatably coupled at the second joint 126 via the first arm 142. In other words, the first arm 142 may be coupled to the support frame 122.

The first rotatable member 130 and the second rotatable member 132 may each be rotatably coupled to the bucket 102 such that the first rotatable member 130 and the second rotatable member 132 may each pivot relative to the bucket 102. The first rotatable member 130 and the second rotatable member 132 may be rotatably coupled to the bucket 102 at a third joint 134 and a fourth joint 136, respectively. The third joint 134 and the fourth joint 136 may each be provided on the bucket bottom 108. In particular, the third joint 134 and the fourth joint 136 may each be provided on the bucket bottom 108 between the seat portion 105 and the toe portion 106. In some embodiments, the third joint 134 and the fourth joint 136 may each be provided beneath a calf portion of the athlete, such as depicted.

In light of FIGS. 1A and 1B, it will now be appreciated that the support frame 122, the first rotatable member 130, the second rotatable member 132, and the bucket 102 may form a traditional four-bar mechanism. Accordingly, the bucket 102 may move relative to the support frame 122 and to the ski 104 during operation of the sit ski 100. In embodiments, one or more of the first joint 124, the second joint 126, the third joint 134, and the fourth joint 136 may be collet-style joints. This may decrease the friction of the first joint 124, the second joint 126, the third joint 134, and/or the fourth joint 136 without sacrificing the tightness or alignment of the respective joint.

In embodiments, the size and position of the first rotatable member 130 and the size and position of the second rotatable member 132 may be configured such that the movement of the bucket 102 during operation is entirely or substantially in a vertical direction. In other words, the size and position of the first rotatable member 130 and the size and position of the second rotatable member 132 may be configured to minimize lateral movement of the bucket 102 during operation of the sit ski 100. For example, during the height of a jump, the ski 104 may be lowered relative to the bucket 102, such as depicted in FIG. 1A. Comparatively, after landing a jump, the ski 104 may be compressed closer to the bucket 102, such as depicted in FIG. 1B. Accordingly, the bucket 102 and the ski 104 may move vertically relative to each other, such as depicted. However, as shown, the bucket 102 may not move laterally (e.g. forward and aft) relative to the ski 104 during this vertical movement. As will be appreciated by those skilled in the art, as the bucket 102 moves laterally (e.g. forward and aft), the sit ski 100 may increase or decrease in speed. Accordingly, by minimizing the lateral movement of the bucket 102, the athlete may better control the speed of the sit ski 100 and may modify the speed of the sit ski 100 by moving the athlete's upper body instead of the bucket 102.

Still referring to FIGS. 1A and 1B, the suspension 120 may include a shock 148 coupled to the support frame 122 and to the bucket 102. Accordingly, the shock 148 may dampen movement of the bucket 102 relative to the support frame 122 and the ski 104. In particular, the shock 148 may be coupled to the support frame 122 directly at a first shock joint 138 and may be coupled to the bucket 102 indirectly at a second shock joint 140 disposed on the second rotatable member 132 of the suspension 120. In some embodiments, the second shock joint 140 may be disposed on the second arm 144 of the second rotatable member 132. In other words, the shock 148 may be coupled to the second arm 144 of the second rotatable member 132.

The suspension 120 may include a bump stop 146 disposed beneath the bucket 102. The bump stop 146 may be coupled to the support frame 122. In particular, the bump stop 146 may extend a vertical distance away from the support frame 122. The bump stop 146 may be configured to contact the bucket 102 at a location such that the bucket 102 is prevented from contacting the support frame 122. The bump stop 146 may comprise a compressible material, such as rubber, such that the bucket 102 may "bottom out" or engage the bump stop 146 when the bucket 102 is at its lowest position without damaging the bump stop 146 or the bucket 102. Accordingly, the shock 148 need not be stiff enough to prevent bottoming out of the bucket 102. This may allow for the shock 148 to be a lower weight shock, thereby enabling the sit ski 100 to be lower weight overall.

Figure 2:
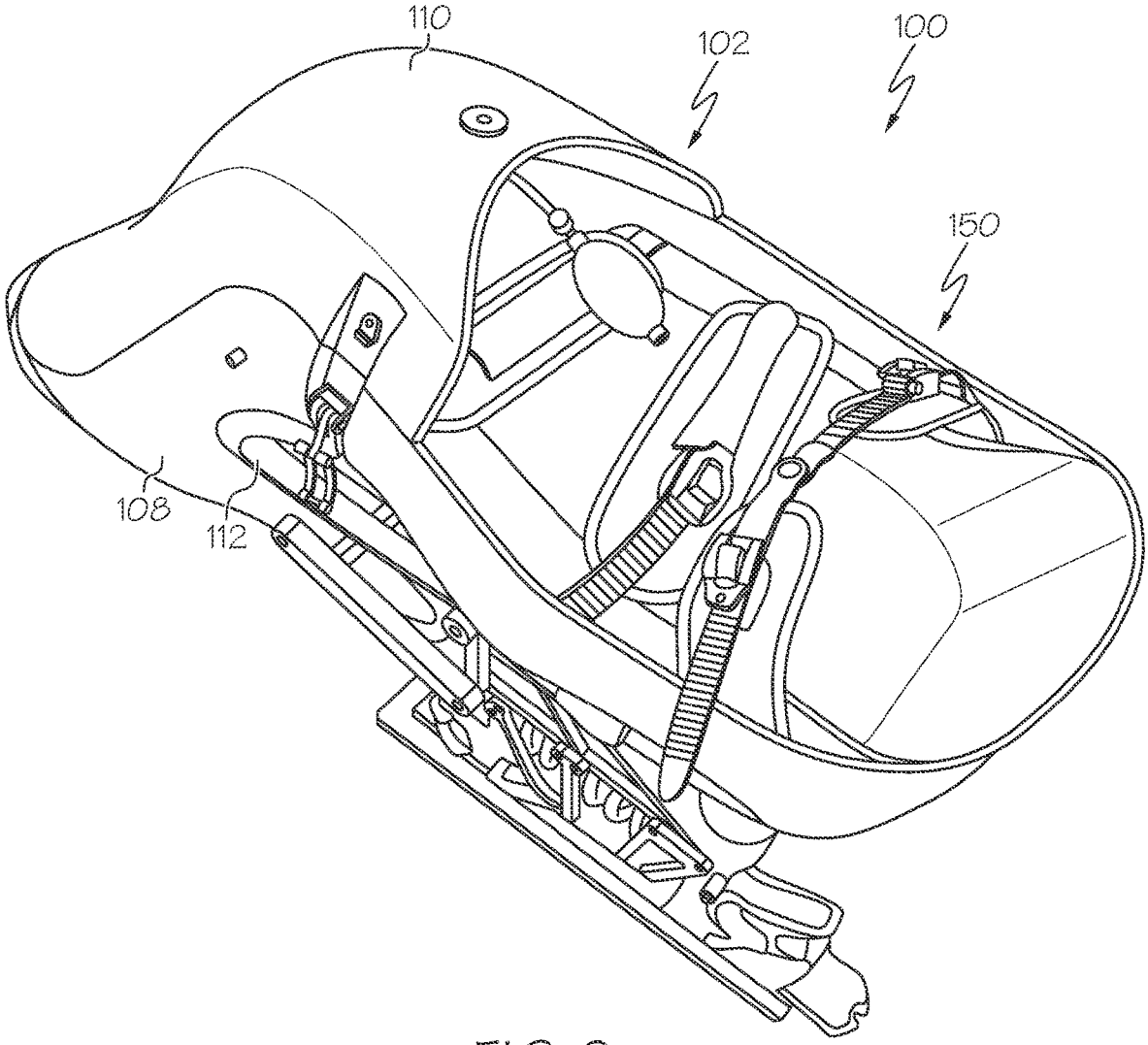
FIG. 2 schematically depicts a top perspective view of the sit ski of FIG. 1A according to one or more embodiments shown and described herein.

Referring to FIG. 2, the sit ski 100 may include one or more straps 150 within the bucket 102. The one or more straps 150 may be configured exert a force on the leg portion of the athlete, thereby retaining the athlete in place within the bucket 102. This may prevent unnecessary movement of the athlete within the bucket 102. The one or more straps 150 may be positioned about a waist portion, a thigh portion, a shin portion, and/or any other portion of the athlete.

Figure 3:
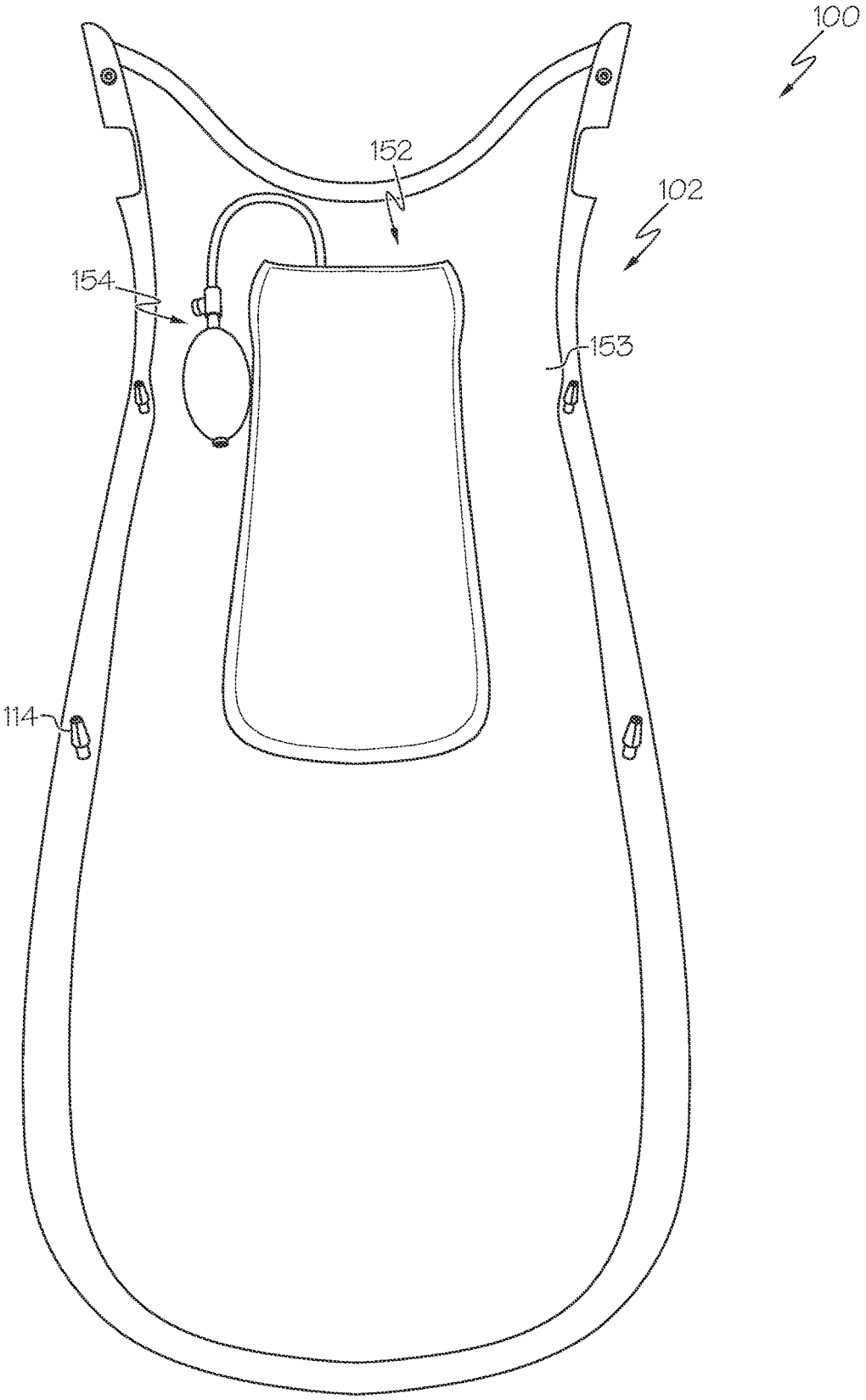
FIG. 3 schematically depicts a top view of a top section of a bucket of the sit ski of FIG. 1A according to one or more embodiments shown and described herein.

Referring now to FIG. 3, the bucket 102 may include an airbag 152 disposed therein. In particular, the airbag 152 may be fixed to an inner surface 153 of the bucket top 110. In this way, the airbag 152 may contact the top of the athlete's leg portion when the athlete is seated within the sit ski 100. In embodiments, the airbag 152 may be positioned on inner surface 153 such that it is positioned above the knee portion of the athlete when the athlete is seated within the sit ski 100. The airbag 152 may exert a pressure on the leg portion of the athlete, which may assist in retaining the athlete within the sit ski 100. This may provide increased comfort to the athlete as it may allow the pressure to be spread over a greater surface area as compared to using the one or more straps 150 alone. Although referred to as an "airbag," the airbag 152 is not limited to being filled with air. The airbag 152 may be filled with air, gel, liquid, foam, other compressible matter, or a combination of materials such that the airbag 152 may exert pressure on the athlete. In some embodiments, the airbag 152 may reduce the amount of pressure required by the one or more straps 150 within the bucket 102. In some such embodiments, the airbag 152 may eliminate the need for one or more straps 150 within the bucket 102. The airbag 152 may include a pump 154. The pump 154 may be operable to manually inflate or deflate the airbag 152. In this way, the athlete may use the pump 154 to control the amount of pressure exerted by the airbag 152. In other embodiments, the airbag 152 may not include the pump 154 and, instead, may be permanently inflated or inflatable via a machine or other means.

Figure 4:
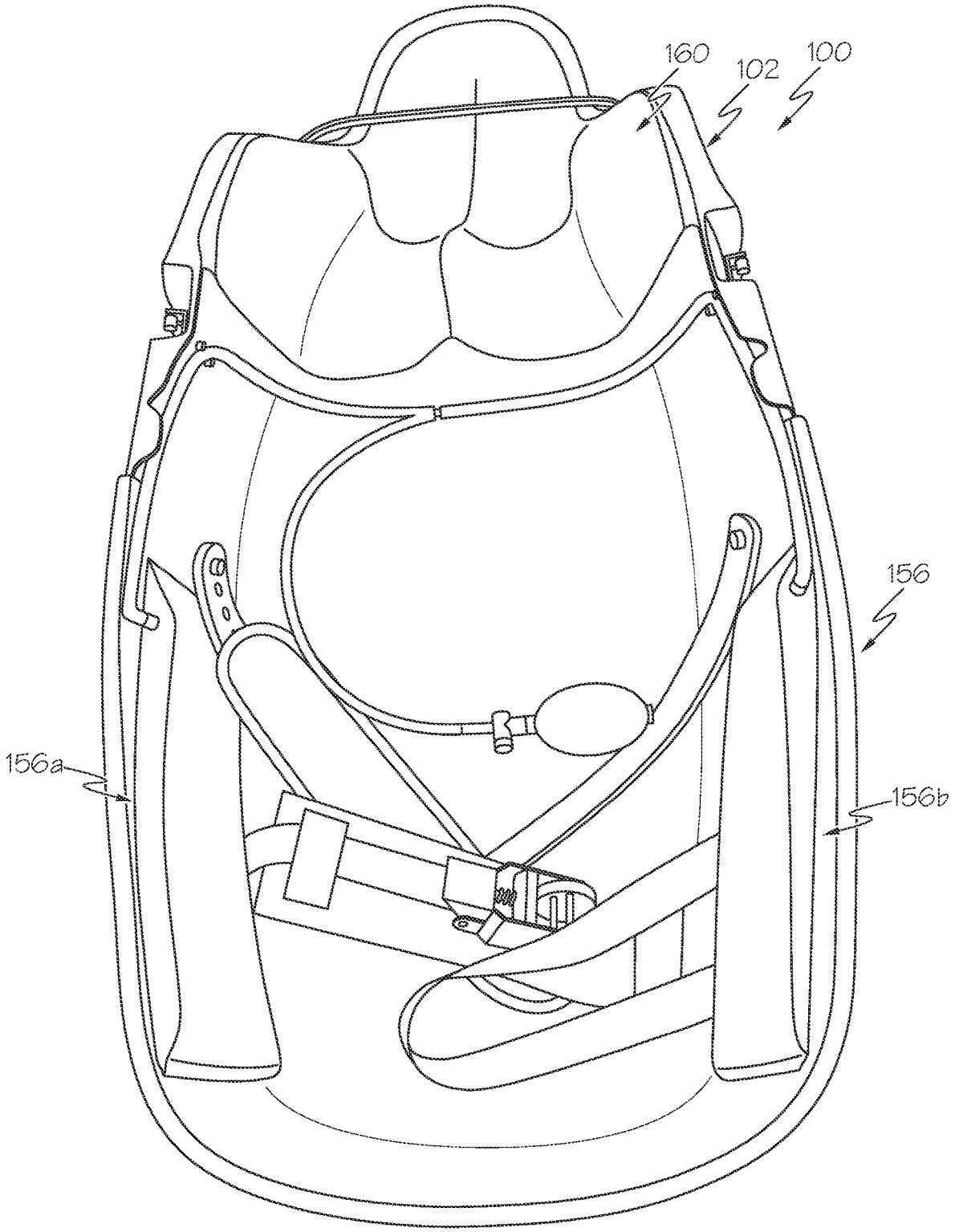
FIG. 4 schematically depicts a top view of a bottom section of the bucket of the sit ski of FIG. 1A according to one or more embodiments shown and described herein.

Referring now to FIG. 4, the sit ski 100 may include one or more additional airbags 156, such as airbags 156*a* and 156*b* disposed within the bucket 102. The one or more additional airbags 156, like the airbag 152, may exert a pressure on the leg portion of the athlete, which may assist in retaining the athlete within the sit ski 100. As depicted, the one or more additional airbags may be coupled to the bucket bottom 108 and may be disposed on the left and right sides of the athlete. This may assist in reducing lateral movement of the athlete during use of the sit ski 100.

Figure 5:
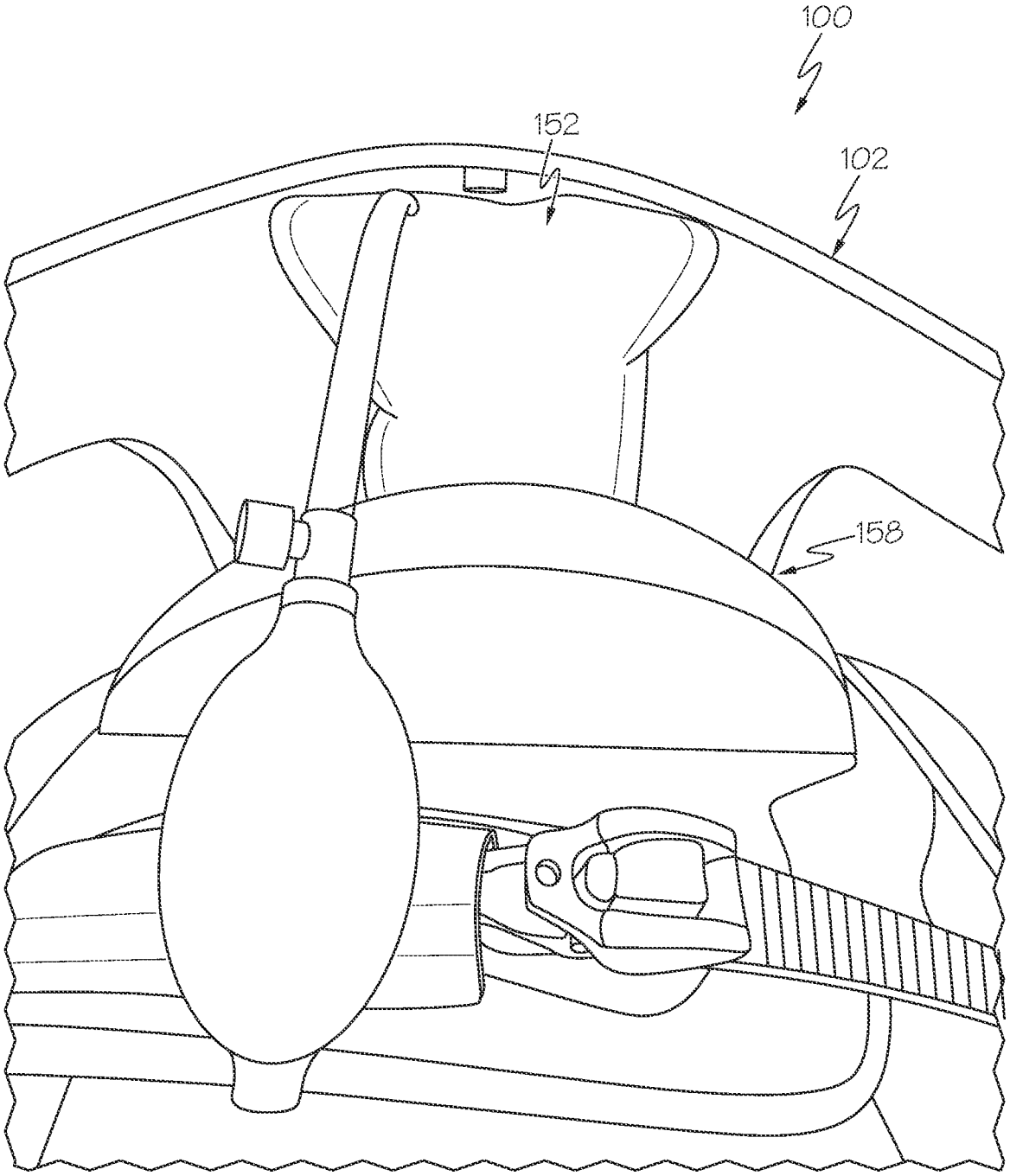
FIG. 5 schematically depicts a partially disassembled view of the bucket of the sit ski of FIG. 1A according to one or more embodiments shown and described herein.

Referring now to FIGS. 4 and 5, the sit ski 100 may include padding 160 disposed within the bucket 102 and coupled to the bucket top 110. The padding 158 may be disposed between the airbag 152 and the leg portion of the athlete. In other words, the airbag 152 may be disposed between the padding 158 and the bucket top 110. Accordingly, the padding 158 may distribute the pressure imposed by the airbag 152, which may provide improved comfort to the athlete. The sit ski may include padding 160 disposed on an inner surface of the bottom section of the bucket 102 (i.e. disposed between the bottom section of the bucket 102 and the leg portion of the athlete).

In view of the above, it should now be understood that at least some embodiments of the present disclosure are directed to a sit ski, which may include a ski, a bucket disposed above the ski and configured to support the athlete, and a suspension disposed between the ski and the bucket. The suspension may include a support frame coupled to the ski, a first rotatable member rotatably coupled to the bucket and to the support frame, a second rotatable member rotatably coupled to the bucket and to the support frame, and a shock coupled to the bucket and to the support frame. In some embodiments, the sit ski may include a weight saving feature such as a bump stop configured to contact the bucket and/or a bucket that fully encloses a leg portion of the athlete. In some embodiments, the bucket may include an airbag disposed therein, which may exert a pressure on the leg portion of the athlete. This may provide increased comfort to the athlete as it may allow the pressure to be spread over a greater surface area.

Further aspects are provided by the subject matter of the following numbered clauses:

1. A sit ski for an athlete includes a ski, a bucket disposed above the ski and configured to support the athlete, and a suspension disposed between the ski and the bucket. The suspension includes a support frame coupled to the ski, a first rotatable member rotatably coupled to the bucket and to the support frame, a second rotatable member rotatably coupled to the bucket and to the support frame, a shock coupled to the bucket and to the support frame, and a bump stop configured to contact the bucket.
2. The sit ski of any preceding clause, wherein the bump stop is coupled to the support frame.
3. The sit ski of any preceding clause, wherein the bump stop comprises a compressible material.
4. The sit ski of any preceding clause, wherein the first rotatable member is coupled to the support frame with a collet style joint.

5. The sit ski of claim any preceding clause, wherein the bucket comprises a bucket bottom configured to support the athlete and a bucket top selectively coupleable to the bucket bottom, wherein the bucket fully encloses a leg portion of the athlete when the bucket top is coupled to the bucket bottom.
6. The sit ski of any preceding clause, wherein the bucket further comprises an airbag disposed on the bucket top of the bucket, the airbag configured to exert a pressure on the athlete.
7. The sit ski of any preceding clause, wherein the airbag comprises a pump operable to manually inflate the airbag.
8. The sit ski of any preceding clause, wherein the bucket top and the bucket bottom each comprise carbon fiber.
9. The sit ski of any preceding clause, wherein the shock is coupled to the bucket indirectly via the second rotatable member.
10. The sit ski of any preceding clause, wherein the second rotatable member comprises a first arm coupled to the support frame and a second arm coupled to the shock.
11. The sit ski of any preceding clause, wherein the first rotatable member and the second rotatable member are sized and positioned such that the bucket moves substantially in a vertical direction.
12. A sit ski for an athlete includes a ski, a bucket disposed above the ski and configured to support the athlete, and a suspension disposed between the ski and the bucket. The bucket includes a bucket bottom, a bucket top selectively coupleable to the bucket bottom, and an airbag disposed on the bucket top. The suspension includes a support frame coupled to the ski, a first rotatable member rotatably coupled to the bucket and to the support frame, a second rotatable member rotatably coupled to the bucket and to the support frame, and a shock coupled to the bucket and to the support frame.
13. The sit ski of any preceding clause, wherein the airbag comprises a pump operable to manually inflate the airbag.
14. The sit ski of any preceding clause, wherein the bucket further comprises padding coupled to the bucket top.
15. The sit ski of any preceding clause, wherein the airbag is disposed between the padding and the bucket top.
16. The sit ski of any preceding clause, wherein the bucket further comprises one or more additional airbags coupled to the bucket bottom.
17. A sit ski assembly includes a ski, a bucket disposed above the ski and configured to support the athlete, and a suspension disposed between the ski and the bucket. The bucket comprising an airbag disposed therein. The suspension includes a support frame coupled to the ski, a first rotatable member rotatably coupled to the bucket and to the support frame, a second rotatable member rotatably coupled to the bucket and to the support frame, a shock coupled to the bucket and to the support frame, and a bump stop configured to contact the bucket.
18. The sit ski assembly of any preceding clause, wherein the bump stop is coupled to the support frame.
19. The sit ski assembly of any preceding clause, wherein the first rotatable member and the second rotatable member are sized and positioned such that the bucket moves substantially in a vertical direction.
20. The sit ski assembly of any preceding clause, wherein the shock is coupled to the bucket indirectly via the second rotatable member.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A sit ski for an athlete comprising:
a ski;
a bucket disposed above the ski and configured to support the athlete, the bucket comprising a bucket bottom configured to support the athlete, a bucket top selectively coupleable to the bucket bottom, and an airbag disposed on the bucket top, the airbag configured to exert a pressure on a leg portion of the athlete, wherein the bucket encloses the leg portion of the athlete when the bucket top is coupled to the bucket bottom; and
a suspension disposed between the ski and the bucket, the suspension comprising:
a support frame coupled to the ski;
a first rotatable member rotatably coupled to the bucket and to the support frame;
a second rotatable member rotatably coupled to the bucket and to the support frame;
a shock coupled to the bucket and to the support frame; and
a bump stop configured to contact the bucket.

2. The sit ski of claim 1, wherein the bump stop is coupled to the support frame.

3. The sit ski of claim 1, wherein the bump stop comprises a compressible material.

4. The sit ski of claim 1, wherein the first rotatable member is coupled to the support frame with a collet style joint.

5. The sit ski of claim 1, wherein the airbag comprises a pump operable to manually inflate the airbag.

6. The sit ski of claim 1, wherein the bucket top and the bucket bottom each comprise carbon fiber.

7. The sit ski of claim 1, wherein the shock is coupled to the bucket indirectly via the second rotatable member.

8. The sit ski of claim 7, wherein the second rotatable member comprises a first arm coupled to the support frame and a second arm coupled to the shock.

9. The sit ski of claim 1, wherein the first rotatable member and the second rotatable member are sized and positioned such that the bucket moves substantially in a vertical direction.

10. A sit ski for an athlete comprising:
a ski;
a bucket disposed above the ski and configured to support the athlete, the bucket comprising a bucket bottom, a bucket top selectively coupleable to the bucket bottom, and an airbag disposed on the bucket top, the airbag configured to exert a pressure on a leg portion of the athlete; and a suspension disposed between the ski and the bucket, the suspension comprising:

a support frame coupled to the ski;

a first rotatable member rotatably coupled to the bucket and to the support frame;

a second rotatable member rotatably coupled to the bucket and to the support frame; and a shock coupled to the bucket and to the support frame.

11. The sit ski of claim 10, wherein the airbag comprises a pump operable to manually inflate the airbag.

12. The sit ski of claim 10, wherein the bucket further comprises padding coupled to the bucket top.

13. The sit ski of claim 12, wherein the airbag is disposed between the padding and the bucket top.

14. The sit ski of claim 10, wherein the bucket further comprises one or more additional airbags coupled to the bucket bottom.

15. A sit ski assembly comprising:

a ski;

a bucket disposed above the ski and configured to support the athlete, the bucket comprising a bucket bottom, a bucket top selectively coupleable to the bucket bottom, and an airbag disposed therein, the airbag configured to exert a pressure on a leg portion of the athlete; and a suspension disposed between the ski and the bucket, the suspension comprising:

a support frame coupled to the ski;

a first rotatable member rotatably coupled to the bucket and to the support frame;

a second rotatable member rotatably coupled to the bucket and to the support frame;

a shock coupled to the bucket and to the support frame; and a bump stop configured to contact the bucket.

16. The sit ski assembly of claim 15, wherein the bump stop is coupled to the support frame.

17. The sit ski assembly of claim 15, wherein the first rotatable member and the second rotatable member are sized and positioned such that the bucket moves substantially in a vertical direction.

18. The sit ski assembly of claim 15, wherein the shock is coupled to the bucket indirectly via the second rotatable member.

* * * * *